United States Patent [19]

Brown

[11] Patent Number: 4,608,135

[45] Date of Patent: Aug. 26, 1986

[54] HALL CELL

[75] Inventor: Melvin H. Brown, Freeport, Pa.

[73] Assignee: Aluminum Company of America, Pittsburgh, Pa.

[21] Appl. No.: 725,623

[22] Filed: Apr. 22, 1985

[51] Int. Cl.[4] ..... C25C 3/06; C25C 3/08; C25C 3/22

[52] U.S. Cl. ..... 204/67; 204/241; 204/246; 204/247; 204/291; 204/294; 204/274

[58] Field of Search ..... 204/67, 243 R, 247, 204/274, 241, 291

[56] References Cited

U.S. PATENT DOCUMENTS

| | | | |
|---|---|---|---|
| 3,673,074 | 6/1972 | Hirt et al. | 204/247 X |
| 3,729,399 | 4/1973 | Kibby | 204/246 X |
| 4,033,846 | 7/1977 | Engesland | 204/247 |
| 4,087,345 | 5/1978 | Sandvik et al. | 204/274 X |
| 4,222,841 | 9/1980 | Miller | 204/274 X |
| 4,410,403 | 10/1983 | Jacobs et al. | 204/243 R X |

*Primary Examiner*—Donald R. Valentine

*Attorney, Agent, or Firm*—Andrew Alexander; John P. Taylor

[57] ABSTRACT

The invention is an improvement in the construction of a Hall cell for the production of aluminum by electrolytic reduction of alumina in a molten salt bath wherein a conductive carbon cathode lining comprising a bottom wall and a sidewall is surrounded adjacent the outer surface thereof with an insulating layer, and a layer of conductive material overlies the inner surface of at least the bottom wall of the carbon lining to reduce the effective spacing between the cathode and one or more anodes in the cell to thereby reduce the power consumption of the cell. The improvement comprises an air passageway between the insulating layer and the outer surface of the carbon lining sidewall and an air inlet port adjacent the bottom of the passageway for passing air into the air passageway and along the outer surface of the carbon lining sidewall whereby the carbon sidewall may be cooled sufficiently to permit the formation of a protective layer of frozen bath on the inner surface thereof. The heated air then flows across the top of the cell whereby the cell retains at least a part of the heat exchanged through the sidewall.

11 Claims, 1 Drawing Figure

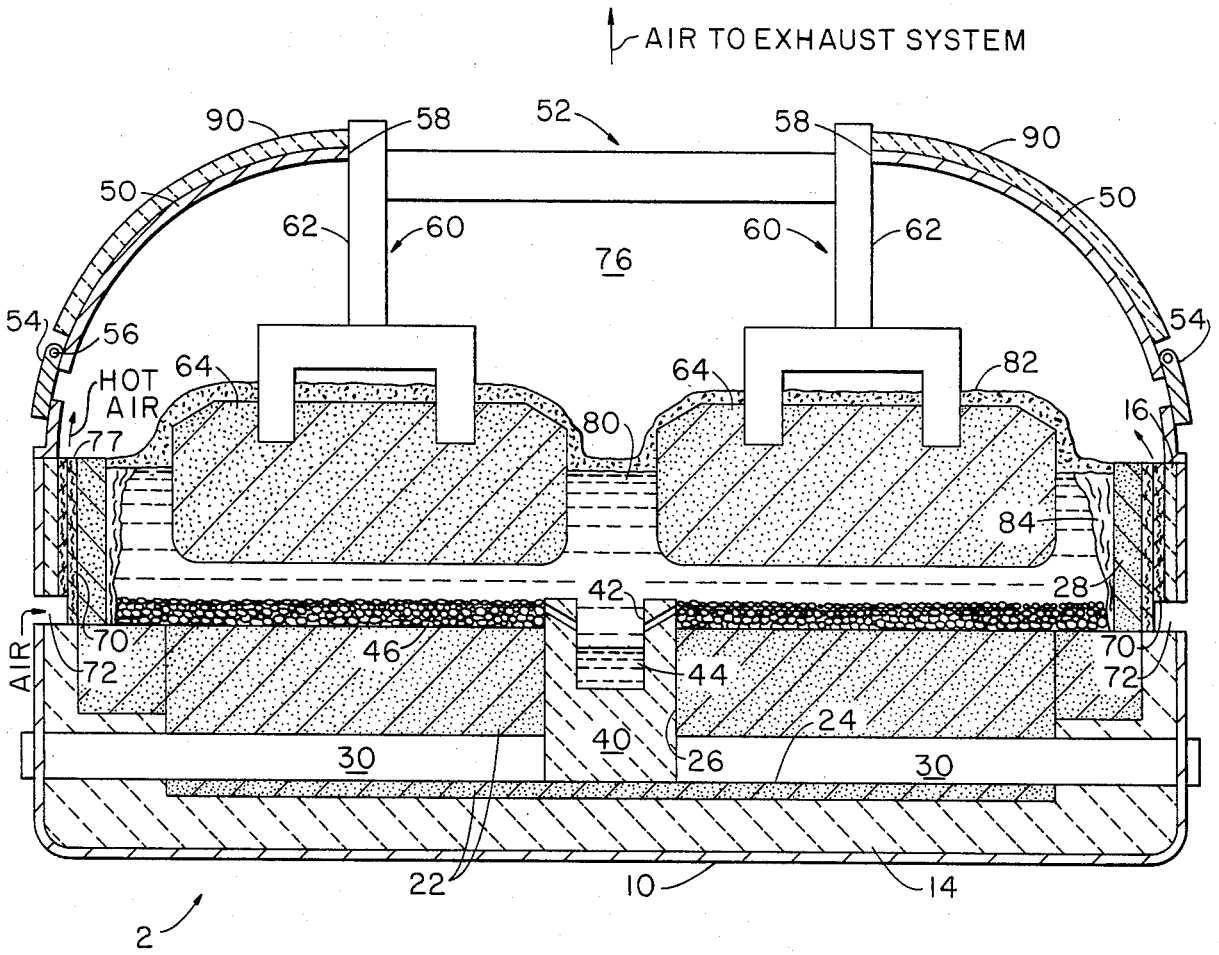
AIR TO EXHAUST SYSTEM
90
58
52
58
90
50
50
62
60
60
62
76
54
56
54
HOT AIR
64
64
82
77
80
16
84
42
28
AIR
70
72
46
44
70
72
24
40
26
30
30
22
10
14
2

HALL CELL

BACKGROUND OF THE INVENTION

1. Field of the Invention

This invention relates to a Hall cell for the electrolytic production of aluminum by reduction of alumina in a molten salt bath. More particularly, this invention relates to an improvement in the construction of a Hall cell having reduced power consumption which will control the amount of heat transferred through the sidewall of the cell to regulate the thickness of protective frozen bath coating on the sidewall of the cell thus permitting the cell to operate at a lower current with closer anode-cathode spacing.

2. Background Art

In the normal operation of a Hall cell, spacing between the anode and the cathode is adjusted to provide sufficient power consumption to not only reduce the alumina to aluminum but to generate sufficient heat to maintain, in a molten state, the salt bath in which the alumina is dissolved.

However, due to erosion of the carbon lining cathode walls of the bath by reaction with the molten salt or the molten aluminum, as it is formed, the cell is conventionally operated at a temperature which permits solidification of a certain amount of the bath on the carbon sidewalls of the cell. This frozen bath lining, then, acts as a protective liner to prevent interaction between the carbon sidewalls and the molten portion of the salt bath.

Due to the ever-increasing costs of electricity and the concurrent need to conserve energy resources, there has been an increased interest in raising the efficiency of the Hall cell operation. It has long been known that a reduction in the spacing between the anodes of the cell and the molten aluminum on the cathode bottom wall would reduce the power consumption ($I^2R$) of the cell. However, a Hall cell does not operate in a quiescent state, and the movement of the molten aluminum in the cell during normal operation could result in shorting out of the cell if the spacing was reduced.

More recently, however, relatively inert conductive cathode materials have been developed which may be used over the carbon cathode bottom wall, for example, in particulate form as a layer spread on top of the carbon cathode bottom wall of the cell, to effectively extend the cathode upward toward the anode and thus reduce the anode-cathode spacing. Such materials, which include $TiB_2$, TiN, $ZrB_2$ or $NbB_2$, may also be used in shaped forms such as plates or the like. When used in such a form, openings are provided through which the molten aluminum may flow so that the inert cathode material, not the molten aluminum, is spaced closest to the anode.

While such an approach is, indeed, satisfactory for the reduction of power consumption in a Hall cell, a concurrent problem has arisen with regard to maintenance of the frozen bath protective lining along the sidewalls of the cell. This is because the reduced power consumption of the cell results in less heat generated so that if sufficient heat is removed from the cell through the sidewalls to permit the formation of frozen bath lining, as in the prior art operation of the cell, the temperature of the cell may be lowered to a dangerous point wherein the entire cell may freeze over.

It, thus, would be desirable to provide a Hall cell having a closer spacing between the anode and cathode, to thereby reduce the amount of power consumed, while still permitting formation of a protective frozen bath lining on the sidewalls of the cell without endangering the operation of the cell due to cell freeze-up.

SUMMARY OF THE INVENTION

It is, therefore, an object of the invention to provide an improved Hall cell having reduced power consumption.

It is another object of the invention to provide an improved Hall cell having reduced power consumption wherein some of the heat generated by the cell may be effectively retained in the cell in an amount sufficient to prevent freeze-up of the cell.

It is yet another object of the invention to provide an improved Hall cell having reduced power consumption wherein some of the heat generated by the cell may be effectively retained in the cell in an amount sufficient to prevent freeze-up of the cell while at the same time heat may be removed through the sidewall to permit formation of a frozen protective layer of bath on the sidewall.

It is a further object of the invention to provide an improved Hall cell having reduced power consumption wherein heat is removed from the cell through the sidewalls to permit formation of a protective layer of solid bath on the sidewalls while retaining sufficient heat within said cell to prevent cell freeze-up by recirculating back into the cell at least a portion of the heat removed through the sidewalls.

It is yet a further object of the invention to provide an improved Hall cell having reduced power consumption wherein heat is removed from the cell through the sidewall thereby permitting formation of a protective layer of solid bath on the sidewall while retaining sufficient heat within said cell to prevent cell freeze-up by recirculating at least a portion of the heat removed from said sidewall back into said cell by circulating air adjacent to the sidewall to remove heat by passing the air through a passageway along the sidewall which leads to the top of the cell whereby the heat is at least partially retained within the cell.

These and other objects of the invention will be apparent from the description and accompanying drawings.

In accordance with the invention, an improvement is provided in the construction of a Hall cell for the production of aluminum by electrolytic reduction of alumina in a molten salt bath wherein a conductive carbon cathode lining comprising a bottom wall and a sidewall is surrounded adjacent the outer surface thereof with an insulating layer, and a conductive material relatively inert to the molten salt bath overlies the inner surface of at least the bottom wall of the carbon lining to reduce the effective spacing between the cathode and one or more anodes in the cell to thereby reduce the current consumption of the cell. The improvement comprises providing an air passageway between the insulating layer and the outer surface of the carbon lining sidewall and providing an air inlet port adjacent the bottom of the passageway for passing air into the air passageway and along the outer surface of the carbon lining sidewall whereby the carbon sidewall may be cooled sufficiently to permit the formation of a protective layer of frozen bath on the inner surface thereof. The heated air then flows across the top of the cell whereby the cell retains at least a part of the heat exchanged through the sidewall.

BRIEF DESCRIPTION OF THE DRAWING

The sole FIGURE is a vertical cross section of the improved Hall cell of the invention.

DESCRIPTION OF THE PREFERRED EMBODIMENT

Referring now to the FIGURE, a Hall cell is generally shown at 2, contained by an outer steel shell 10. Within steel shell 10 is a refractory insulative lining 14 selected to have a low thermal conductivity as well as resistance to attack by molten metal. A carbon lining, which forms the cathode of the cell, is located within refractory lining 14 comprising a bottom lining 22 and a side carbon lining 28. Bottom carbon lining 22 is provided with openings at 24 through which may be inserted metal current collector bars 30 to provide the electrical current to the cathode of cell 2. Carbon lining 22 is also provided with a groove at 26 to receive a sump member 40 having a sump 42 therein to receive molten metal as it is formed in the cell. Preferably, member 40 is constructed of a material, such as $TiB_2$, TiN, $ZrB_2$ or $NbB_2$ material which is resistant to attack by molten aluminum.

In the preferred embodiment, bottom carbon lining 22 may be covered by particles 46 of a conductive material capable of withstanding attack by the molten salt bath such as the same material forming sump member 40, e.g., a $TiB_2$ material. Alternatively, as previously discussed, formed shapes of such materials such as plates may be used with holes therein to permit flow-through of the molten aluminum as it forms. Particles 46, preferably, have a particle size range of from about 1 to 5 cm.

Cell 2 is further provided with a steel cover member 50 having a central air exit port 52 thereon for a purpose which will be explained below. Cover member 50 is fitted with hinged sections 54 which are pivotally mounted at 56 to permit selected opening of hinged section 54 to permit entrance of cool outside air into the top of the cell, as will be described below.

Cover member 50 is also provided with openings 58 through which pass steel rods 62 which form the support and current carrying rods for anodes 60. The steel rods 62 are embedded into carbon blocks 64 which form the portion of anode 60 which is in contact with molten salt bath 80. A frozen crust 82 of solidified salt bath is shown over the surface of molten salt bath 80 and anode carbon blocks 64.

In accordance with the invention, side carbon lining 28 is positioned on bottom carbon lining 22 a sufficient distance inwardly from sidewall refractory lining 16 to define a passageway 70 therebetween. Passageway 70, in turn, is in communication with an air entry port 72 formed in the sidewall of steel shell 10 and side refractory lining 16 adjacent the bottom of side carbon lining 28. Cool air from outside cell 2 enters passageway 70 via entry port 72 and flows along the outer surface of sidewall carbon lining 28 to thereby cool the carbon lining and thus permit formation of a protective layer of frozen bath 84 along the inner surface of carbon lining 28. It may be desirable to provide a protective coating over the outer surface of carbon lining 28 at this point to prevent oxidation of that portion of the carbon lining in contact with air. This air, now heated by exchange with the heat in carbon lining 28, passes out of passageway 70 into the upper area 76 of cell 2 defined by cover 50 and frozen upper crust layer 82 where the air then eventually exits cell 2 via central exit port 52. Thus, the heat removed from cell 2 by the air passing through passageway 70 is returned, at least in part, to cell 2 in space 76 within the cell.

Hinged sections 54 may be opened or shut to regulate the amount of heat which is exchanged through carbon sidewall 28 by acting as a bypass to adjust the amount of air which will enter cell 2 through port 72. Thus, for a given amount of air exhausted from the cell via exit port 52, all of the air may be passed through passageway 70 from inlet port 72 to provide a maximum amount of heat withdrawn through sidewall 28 or, alternatively, the amount of inlet air may be reduced by opening hinged section 54, thus diverting at least some of the air flow.

In a preferred embodiment, turbulator means 77 are provided in passageway 70 which may comprise a fibrous packing material or the like, capable of withstanding the temperature adjacent the outer surface of carbon lining 28. Turbulator means 77 functions to increase transfer of heat from carbon lining 28 to the air passing through passageway 70.

In operation of the improved Hall cell, then, anode assemblies 60 are lowered into molten bath 80 to a position just above the conductive material 46 to provide efficient reduction of the alumina in bath 80 to form aluminum which then collects in sump 42 at 44. The heat, generated by the current flow, maintains the salt bath in a molten condition. As some of this heat flows to sidewall 28, the air passing through passageway 70 cools lining 28 thereby permitting the formation of the protective frozen bath layer 84 on the sidewalls of carbon lining 28, thus protecting carbon lining 28 from attack by the molten salt bath. Depending on the position of the anodes with respect to the conductive material 46 which forms the cathode surface, the opening or closing of hinged portions 54 may be adjusted to provide sufficient heat exchange for formation of a frozen bath lining 84 sufficiently thick to protect carbon lining 28 while not permitting layer 84 to grow unduly thick which would interfere with the operation of cell 2.

In a preferred embodiment, the heat of the hot air circulating within chamber 76 of cell 2 from passageway 70 may be further conserved by providing a layer of insulation 90 on the outer surface of cover member 50. Insulative layer 90 may comprise a refractory material or a fiberglass type of insulation.

Thus, the improved Hall cell of the invention provides a structure wherein the power consumption for production of a given amount of aluminum is reduced without suffering the risk of operating the cell at a temperature wherein the bath may freeze up or at a higher temperature wherein an insufficient amount of frozen bath will form on the sidewalls of the cell and, thus, result in erosion of the carbon sidewalls.

Having thus described the invention, what is claimed is:

1. An improved cell apparatus for the production of metal by electrolytic reduction of metal bearing material dissolved in a molten salt bath wherein a conductive carbon cathode lining comprising a bottom wall and a sidewall is surrounded adjacent the outer surface thereof with an insulating layer within a steel shell, and a stable cathode material in electrical communication with said conductive carbon cathode lining is located adjacent the bottom of said cell to reduce the effective spacing between the cathode and one or more anodes in the cell to thereby reduce the current consumption of the cell, the improvement comprising:

(a) an air passageway between said insulating layer and the outer surface of said carbon lining sidewall;
(b) an air inlet port for passing air into said air passageway adjacent the bottom of said passageway;
(c) a cover over said cell attached to said steel shell having a central air exit port means therein and defining an upper area within said cell above said molten bath; and
(d) means for passing air from said passageway into said upper area defined by said cover and said molten bath to thereby retain in said cell at least a portion of the heat from the heated air from said passageway;

whereby said carbon sidewall may be cooled sufficiently to permit the formation of a protective layer of frozen bath on the inner surface thereof while at least a portion of said heat extracted from said sidewall is returned to said cell by circulating said heated air across the top of said cell before removing said air from said cell through said central air exit port.

2. The apparatus of claim 1 wherein said cover is provided with at least one adjustable air entry port adjacent the sidewall whereby the amount of air passing through said passageway may be regulated to control the amount of heat transferred through said sidewall.

3. The apparatus of claim 2 wherein turbulating means are provided in said passageway to improve the heat transfer from said sidewall.

4. The apparatus of claim 3 wherein said stable cathode material is selected from the class consisting of $TiB_2$, TiN, $ZrB_2$ and $NbB_2$.

5. The apparatus of claim 4 wherein said stable cathode material adjacent said bottom conductive wall comprises a particulated material which permits closer spacing of said anode to said cathode to reduce the amount of electricity used thereby reducing the amount of heat generated by said cell.

6. The apparatus of claim 4 wherein said stable cathode material adjacent said bottom conductive wall comprises a formed material having passages therein to permit molten aluminum to flow therethrough which permits closer spacing of said anode to said cathode to reduce the amount of electricity used thereby reducing the amount of heat generated by said cell.

7. The apparatus of claim 2 wherein said cover is insulated to further conserve the heat loss within said cell.

8. An improved Hall cell for the electrolytic production of aluminum by reduction of an aluminum-bearing material dissolved in a molten salt bath, said cell being characterized by reduced power consumption due to reduced anode-cathode distance comprising:
(a) an outer shell comprising a bottom wall and one or more sidewalls;
(b) a layer of insulating material within said shell;
(c) a conductive carbon lining within said layer of insulating material forming the cathode for said cell and spaced from said insulating material on said sidewall;
(d) a stable cathode material over at least the bottom portion of said conductive carbon lining, said stable cathode material being capable of permitting the flow therethrough of molten aluminum;
(e) collector current means connecting said conductive carbon lining to an external power source;
(f) a cell cover removably attached to said shell to define an enclosed air space above the molten salt bath in said cell, said cover being further provided with a central air exit port therein;
(g) one or more anode members protruding through said cell cover into said cell and connected to said external power source;
(h) air entrance port means passing through said shell and said layer of insulating material adjacent the bottom of said sidewall;
(i) air passageways in the sidewall of said cell between said layer of insulating material and said carbon lining between said air entrance port and said air space above said molten salt bath to permit air entering said air passageway from said air entrance port to cool the sidewall of said cell and then to circulate in said enclosed air space beneath said cover and above said molten salt bath to thereby retain in said cell at least a portion of the heat removed through said sidewalls; and
(j) adjustable port means in said cover adjacent the end edge thereof to permit a preselected amount of air to enter said cell bypassing said air passageway whereby the amount of heat transferred through said sidewall can be controlled.

9. The cell of claim 8 wherein said stable cathode material is selected from the class consisting of $TiB_2$, TiN, $ZrB_2$ and $NbB_2$.

10. A method of efficiently operating a Hall cell for the electrolytic reduction of aluminum in a molten salt bath in a manner which consumes less electrical power while maintaining sufficient heat within said cell to prevent freeze-up of the cell and withdrawing sufficient heat through the sidewall of the cell to form a protective layer of frozen bath over the carbon sidewall which comprises:
(a) providing adjacent at least the bottom surface of an anode in said cell a cathodic layer of a material capable of withstanding attack by molten aluminum whereby the anode-cathode spacing may be reduced to lower the current consumed and heat generated by said cell;
(b) circulating air from outside the cell over the outer surface of a carbon sidewall lining in said cell through passageways formed in the sidewall of said cell between said carbon sidewall lining and an insulating layer provided within an outer shell of said cell to cool the sidewall sufficiently to permit formation of a protective layer of frozen bath over said carbon sidewall; and
(c) circulating said air from said passageways heated by contact with said carbon sidewall across an area in the upper portion of said cell above said molten salt bath defined by said molten salt bath and a cover over said cell attached to said outer shell of said cell;

whereby at least a portion of the heat removed through said carbon sidewall by said air is returned to said cell to conserve sufficient heat in said cell to permit efficient operation without cell freeze-up.

11. The method of claim 10 including the further step of controlling the amount of heat transferred through said sidewalls by permitting air to enter said cell through adjustable port means in said cover which bypass said passageway to thereby control the amount of air flowing through said passageway.

* * * * *